US009752276B2

(12) United States Patent
Ye et al.

(10) Patent No.: US 9,752,276 B2
(45) Date of Patent: Sep. 5, 2017

(54) CLOTHES TREATING APPARATUS

(71) Applicant: LG ELECTRONICS INC., Seoul (KR)

(72) Inventors: Sungmin Ye, Seoul (KR); Sungho Song, Seoul (KR); Jongseok Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/166,629

(22) Filed: May 27, 2016

(65) Prior Publication Data

US 2016/0348302 A1 Dec. 1, 2016

(30) Foreign Application Priority Data

May 29, 2015 (KR) ..... 10-2015-0076534

(51) Int. Cl.

| | |
|---|---|
| ***D06F 59/02*** | (2006.01) |
| ***A47G 25/20*** | (2006.01) |
| ***D06F 58/10*** | (2006.01) |

(52) U.S. Cl.

CPC ..... *D06F 59/02* (2013.01); *A47G 25/20* (2013.01); *D06F 58/10* (2013.01)

(58) Field of Classification Search

CPC ..... D06F 59/02; D06F 58/10; A47G 25/20
See application file for complete search history.

(56) References Cited

U.S. PATENT DOCUMENTS 2,097,809 A * 11/1937 Brock ..... A47G 25/20 223/69
2,120,748 A * 6/1938 Harris ..... D06F 59/02 223/69
4,109,838 A * 8/1978 Dwek ..... A47G 25/20 223/91

(Continued)

FOREIGN PATENT DOCUMENTS

JP 2006-167204 6/2006
JP 2013-248366 12/2013

(Continued)

OTHER PUBLICATIONS

Korean Office Action dated May 11, 2016 issued in Application No. 10-2015-0076534.

(Continued)

*Primary Examiner* — Shaun R Hurley
*Assistant Examiner* — Andrew W Sutton
(74) *Attorney, Agent, or Firm* — Ked & Associates, LLP

(57) ABSTRACT

A clothes treating apparatus is provided. The clothes treating apparatus may include a housing having an accommodation space therein, and a hanger accommodated in the accommodation space and configured to hang a clothing item thereon. The hanger may include a hook configured to be detachably mounted to the housing, a frame having a first extension and a second extension that extend out in two directions from the hook and configured to support the clothing item by at least one of the first and second extensions, a body bar that connects to the first and second extensions and extends between the first and second extensions so as to press the clothing item outwards, and a clip provided at a lower portion of the hanger and configured to fix the clothing item.

17 Claims, 8 Drawing Sheets

(56) References Cited

U.S. PATENT DOCUMENTS

| | | | | |
|---|---|---|---|---|
| 4,669,642 | A | 6/1987 | Nicholas | |
| 7,140,121 | B2 * | 11/2006 | Casella | D06F 58/10 34/201 |
| 2008/0217364 | A1 * | 9/2008 | Fong | D06F 59/02 223/90 |
| 2016/0348302 | A1 * | 12/2016 | Ye | A47G 25/20 |

FOREIGN PATENT DOCUMENTS

| | | |
|---|---|---|
| KR | 10-2010-0075577 | 7/2010 |
| KR | 10-2010-0105939 | 10/2010 |
| KR | 10-1052483 | 7/2011 |
| KR | 10-2012-0091799 | 8/2012 |
| KR | 10-2013-0044509 | 5/2013 |

OTHER PUBLICATIONS

European Search Report dated Oct. 6, 2016 issued in Application No. 16171742.6.

* cited by examiner

CLOTHES TREATING APPARATUS

CROSS-REFERENCE TO RELATED APPLICATION

This application claims priority under 35 U.S.C. §119(a) to Korean Application No. 10-2015-0076534, filed on May 29, 2015, whose entire disclosure is incorporated herein by reference.

BACKGROUND OF THE INVENTION

1. Field

Embodiments relate to a clothes treating apparatus.

2. Background

Various types of clothes treating apparatuses, such as, e.g., a washing machine to wash items, exist. Other examples may include a drum type drier to dry items or clothes that have been washed, a cabinet type drier to dry items or clothes that may hang inside, and a refresher to refresh items or clothes by supplying blasts of hot air. Among these clothes treating apparatuses, driers and refreshers may be configured to supply a blast of hot air heated by a heater to items such as clothes. Such a heater may include a gas heater that heats air through gas combustion or an electric heater that heats air by an electric resistance. Electric heaters have been utilized due to easy installation and their simple structures.

A clothes treating apparatus may be capable of supplying hot air to items or clothes accommodated therein, and capable of supplying steam to the items or clothes in order to remove wrinkles therefrom. Some clothes treating apparatus may be configured to pull items or clothes such that tension is applied to the items or clothes, and to remove wrinkles by supplying steam to the items or clothes. However, if the items or clothes are pulled in one direction for removal of wrinkles, new wrinkles may be generated in that direction, for example, a horizontal direction or a vertical direction.

BRIEF DESCRIPTION OF THE DRAWINGS

The embodiments will be described in detail with reference to the following drawings in which like reference numerals refer to like elements wherein.

DETAILED DESCRIPTION

Figure 1:
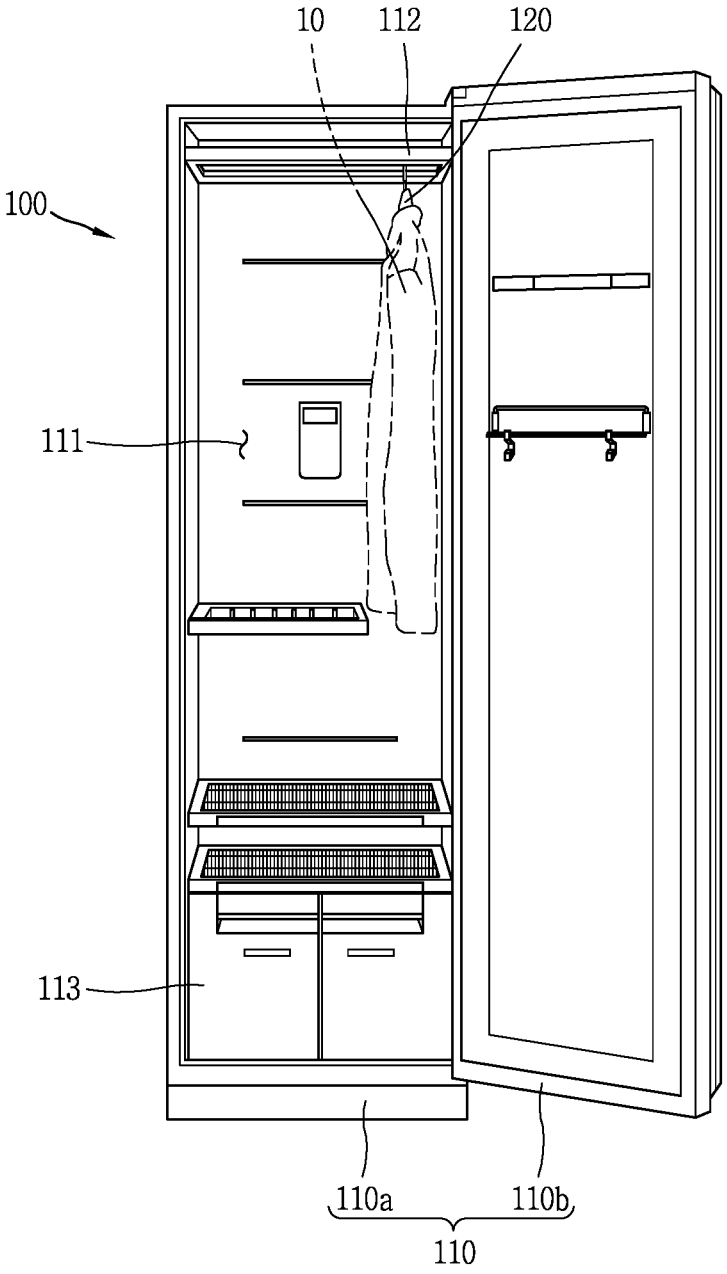
FIG. 1 is a conceptual view of a clothes treating apparatus according to an embodiment.

Referring to FIG. 1, a clothes treating apparatus 100 may include a housing 110 having an accommodation space 111 to accommodate items such as clothes therein, and a wrinkle remover configured to hang clothes thereon such that a predetermined tension may be applied to the clothes. The housing 110 may form an outer appearance of the clothes treating apparatus 100. The housing 110 may include a housing body 110*a* having the accommodation space 111, and a door 110*b* configured to open and close the accommodation space 111. A supporting member or support 112 configured to hang clothes thereon may be provided at the accommodation space 111.

The accommodation space 111 may communicate with outside the accommodation space 111 as the door 110*b* is open and closed. For example, the door 110*b* may be hinge-coupled to the housing body 110*a* and may be configured to open and close the accommodation space 111 by rotation. Alternatively, the door 110*b* may be configured to open and close the accommodation space 111 by being inserted into or withdrawn from the accommodation space 111 in a sliding manner. In this case, a support configured to hang clothes thereon may be provided at the door 110*b*.

A hot blast supply device or hot air supplier configured to selectively supply blasts of hot air into the accommodation space 111, and a steam supply device or steam supplier configured to selectively supply steam into the accommodation space 111 may be provided in the housing 110. The hot air supplier and the steam supplier may be additionally provided in a mechanical chamber 113. The hot air supplier and the steam supplier are known to one of ordinary skill in the art, and detailed explanations thereof have been omitted. Steam and hot air supplied to the accommodation space 111 may, for example, serve to remove wrinkles from clothes, to deodorize clothes, and to restore an original shape of clothes. In order to effectively remove wrinkles from clothes, steam may be sprayed into or onto the clothes when the clothes are pulled while being hung. Accordingly, the clothes treating apparatus 100 may be provided with a wrinkle remover configured to apply a predetermined tension to clothes.

The wrinkle remover may be configured to hang clothes thereon, and to apply a predetermined tension to the clothes by pulling or pushing the clothes. The wrinkle remover may fix to clothes such that wrinkles may be removed while the clothes are hung. The wrinkle remover may include a hanger 120 configured to remove wrinkles from an item of clothing 10, such as, e.g., a shirt or a blouse. The wrinkle remover may further include, for example, at least one crease generator 130 (e.g., a tong) and a pocket wrinkle remover 140 (e.g., a tong).

Figure 2:
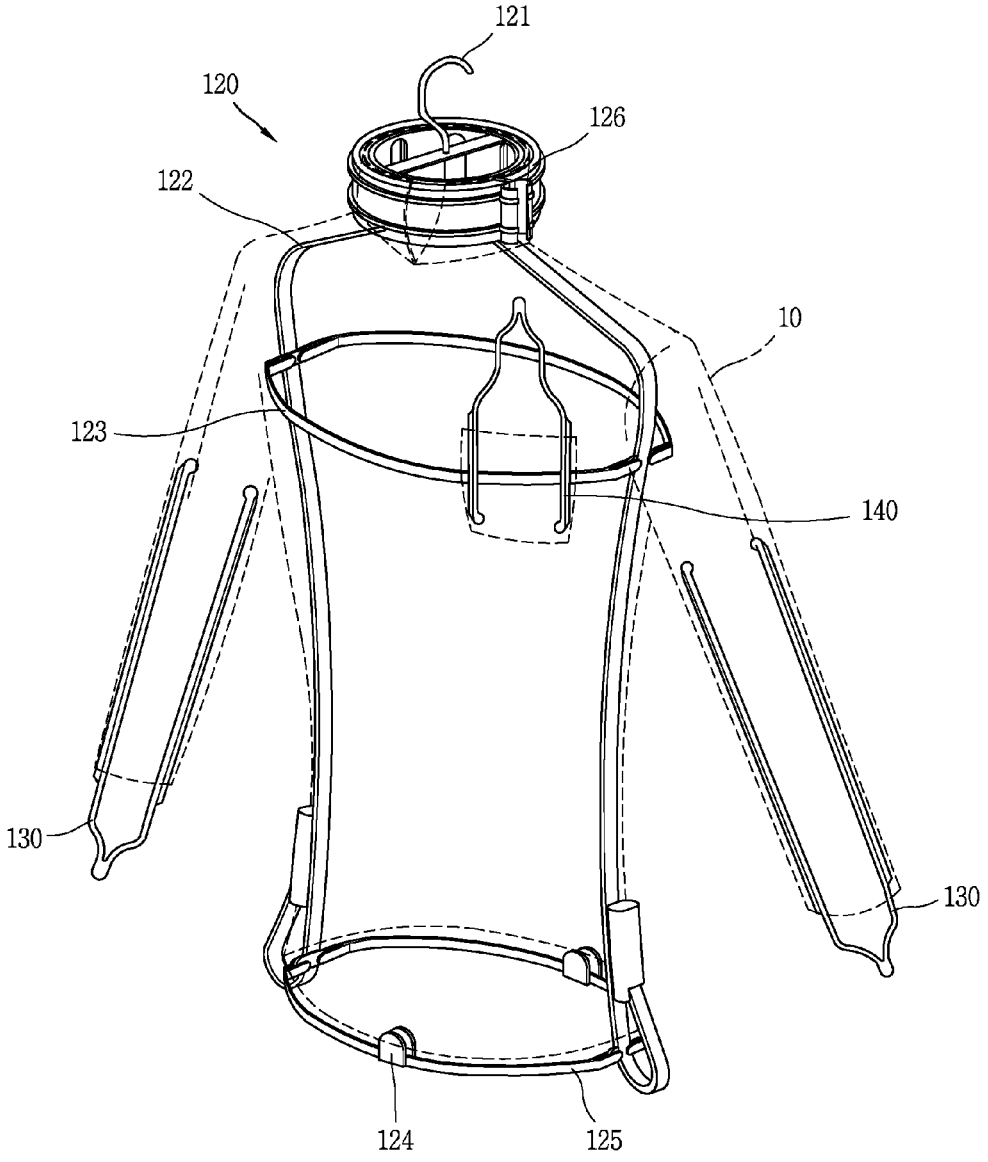
FIG. 2 is a conceptual view illustrating a state where an item of clothing may be hung on a hanger of FIG. 1.

Referring to FIG. 2, the clothing item 10 may be hung on the hanger 120, and may be configured to receive tension from a plurality of directions by being outwardly pressed or pulled by a body bar 123 and a clip 124. A portion of the clothing item 10 may be hung on the hanger 120 in an expanded state so as to have wrinkles removed therefrom when steam is sprayed. A collar of the clothing item 10 may have wrinkles removed therefrom by being pressurized by a collar press 126.

The crease generator 130 may be inserted into an arm region of the clothing item 10, such that desired creases may be generated on the arm region from the shoulder to the wrist. The crease generator 130 may be configured to be hung on the arm region of the clothing item 10 after at least a portion thereof is inserted into the arm region. With such a configuration, a predetermined tension may be applied to the arm region. If a pocket is provided at or on the clothing item 10, a pocket wrinkle remover 140 configured to remove wrinkles from the pocket by pulling the pocket may be inserted into the pocket. The pocket wrinkle remover 140 inserted into the pocket may be configured to be moved out toward two sides of the pocket.

Figure 3:
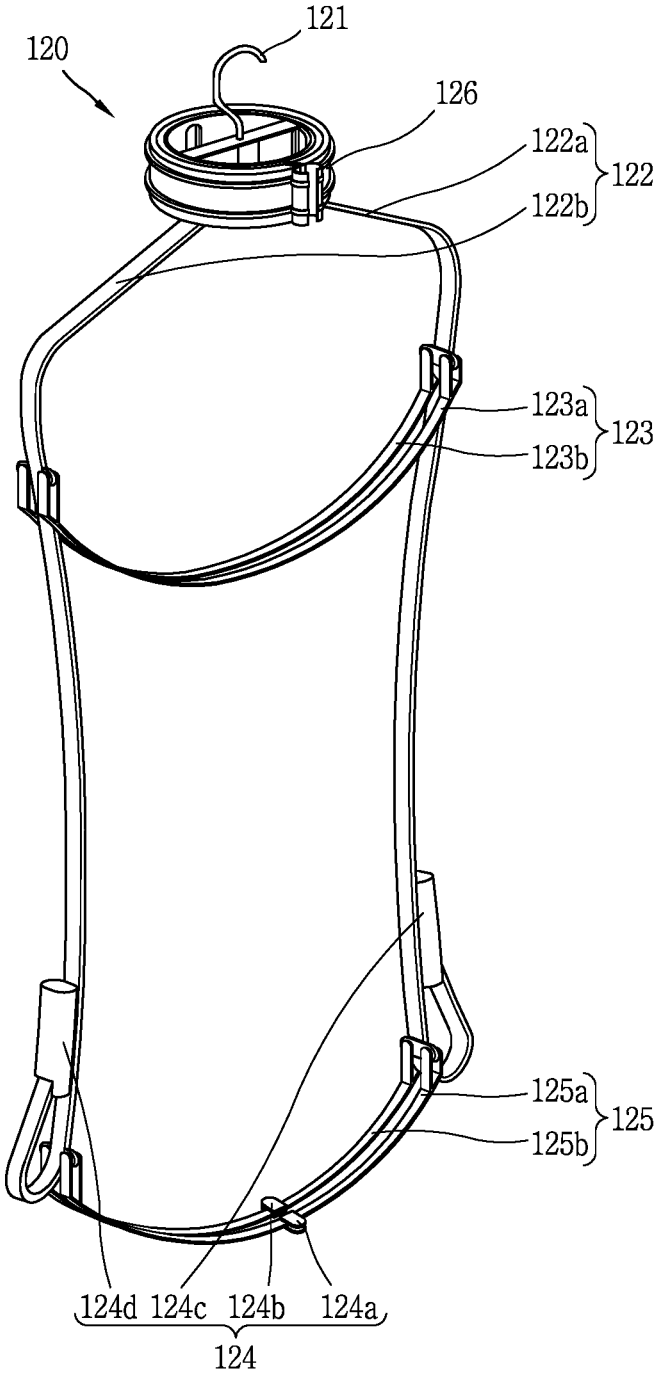
FIG. 3 is a perspective view of the hanger of FIG. 2.

Referring to FIG. 3, the hanger 120 may include a hooking part or hook 121, a frame 122, a body bar 123 and a clip 124. The hook 121 may be detachably mounted to the housing 110. As shown in FIG. 1, the hook 121 may be formed to have a hook shape and may be detachably mounted to the support 112 provided at or in the accommodation space 111. Alternatively, the hook 121 may be detachably mounted to the support 112 so as to be fitted and not hung.

The frame 122 may include a first extension 122*a* and a second extension 122*b* that extend from two sides of the hook 121 in order to support the clothing item 10 by at least one of the first and second extensions. The first and second extensions 122*a*, 122*b* may include upper regions that extend downward at an incline from the hook 121 outward from the two sides to support shoulder portions of the clothing item 10 and lower regions that extend downward from the upper regions and correspond to sides of the clothing item 10. Each of the first and second extensions 122*a*, 122*b* may have a small thickness and may be flexible or bendable. The first and second extensions 122*a*, 122*b* may be formed of various materials including, for example, a metallic material and/or a synthetic resin. In order to prevent the clothing item 10 from sliding, a sliding preventer formed of, for example, silicone or fabric, may be additionally provided at the upper regions of the first and second extensions 122*a*, 122*b*.

The body bar 123, which extends between the first and second extensions 122*a*, 122*b* so as to press the clothing item 10 hung on the frame 122 outwards, may be provided between the hook 121 and the clip 124. For example, the body bar 123 may extend in a horizontal direction by being connected or coupled to the first and second extensions 122*a*, 122*b*. The body bar 123 may push the clothing item 10 in a direction crossing or substantially perpendicular to a pulling direction of the clothing item 10 by the clip 124. One body bar 123 may be provided between the hook 121 and the clip 124, but embodiments are not limited thereto. A plurality of body bars 123 may be provided between the hook 121 and the clip 124, with a predetermined interval therebetween.

The clip 124 may be provided at a lower portion of the hanger 120, and may be configured to fix or attach the clothing item 10 hung on the frame 122. The clip 124 may be formed as clamps. The clothing item 10 may be pulled by the clip 124 hanging on the hanger 120, thereby providing a predetermined tension in a substantially up/down or vertical direction. If the body bar 123 extends between the first extension 122*a* and the second extension 122*b*, a predetermined tension may be applied in back and forth and right and left directions. As a result, since the clothing item 10 receives tension in all directions including upper, lower, forward, backward, right and left directions while being balanced or hung, wrinkle removing function may be improved. This may prevent occurrence of wrinkles in items such as clothing in upper and lower directions. The clothing item 10 may be a shirt having a collar on or at a neck portion. In order to remove wrinkles from a collar, the hanger 120 may further include a collar press 126 configured to compress the collar of the clothing item 10 hung on the frame 122.

Figure 4:
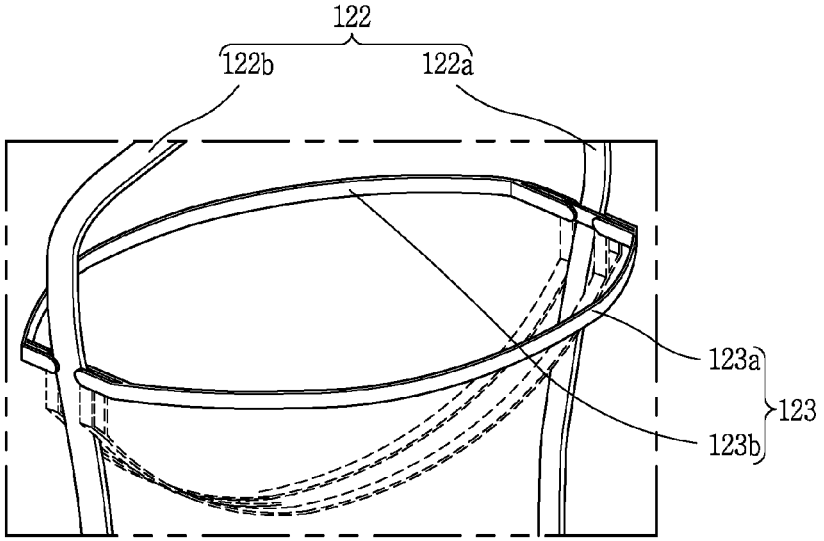
FIG. 4 is a conceptual view illustrating an unfolded state of a body bar of FIG. 3.

Referring to FIG. 4, the body bar 123 may be formed between the hook 121 and the clip 124, and may be configured to press the clothing item 10 hung on the frame 122 outward. The body bar 123 may be formed to extend in a horizontal direction, such that a pressing force may be uniformly transmitted to right and left sides of the clothing item 10. Since the body bar 123 is formed to contact the clothing item 10, an external surface of the body bar 123 may be covered with a soft material such as, e.g., fabric, to prevent damage during contact. The body bar 123 may be formed of a ductile material so as to be flexibly transformed to correspond to a size of the clothing item 10.

The body bar 123 may be provided with a first rotatable bar 123*a* and a second rotatable bar 123*b* hinge-coupled to the first and second extensions 122*a*, 122*b*, respectively, and that rotate so as to protrude in back and forth directions. The first and second rotatable bars 123*a*, 123*b* may be configured to be folded for a minimized volume of the hanger 120 when not used, but to be unfolded when used.

The first and second rotatable bars 123*a*, 123*b* may have an arc shape in order to prevent wrinkles or pressed marks on the clothing item 10 due to their shape when the clothing item 10 is pressed. The first and second rotatable bars 123*a*, 123*b* may be configured to have their rotation angle with respect to the frame 122 or their degree of protrusion with respect to the first and second extensions 122*a*, 122*b* be controllable. A user may control a degree of protrusion of the first and second rotatable bars 123*a*, 123*b* to correspond to, for example, a size or a material of the clothing item 10. The first and second rotatable bars 123*a*, 123*b* may be formed to be fixed at preset rotation angles with respect to the frame 122. Alternatively, the first and second rotatable bars 123*a*, 123*b* may be formed to be fixed at arbitrary rotation angles with respect to the frame 122.

A rotation angle of the first rotatable bar 123*a* with respect to the frame 122, and a rotation angle of the second rotatable bar 123*b* with respect to the frame 122, may be individually controlled. Alternatively, as one of the first and second rotatable bars 123*a*, 123*b* is rotated, another may be rotated. The first and second rotatable bars 123*a*, 123*b* may be formed so as to be rotatable and to be fixed by being hinge-coupled to the first and second extensions 122*a*, 122*b* in a forcibly-fitted manner. Alternatively, the first and second rotatable bars 123*a*, 123*b* may be formed so as to be rotatable and to be fixed by being hinge-coupled to the first and second extensions 122*a*, 122*b* in a gear coupling manner. In case of the gear coupling manner, the first and second rotatable bars 123*a*, 123*b* may be connected to each other by gears. With such a configuration, as one of the first and second rotatable bars 123*a*, 123*b* is rotated, the other may be rotated.

Figure 5:
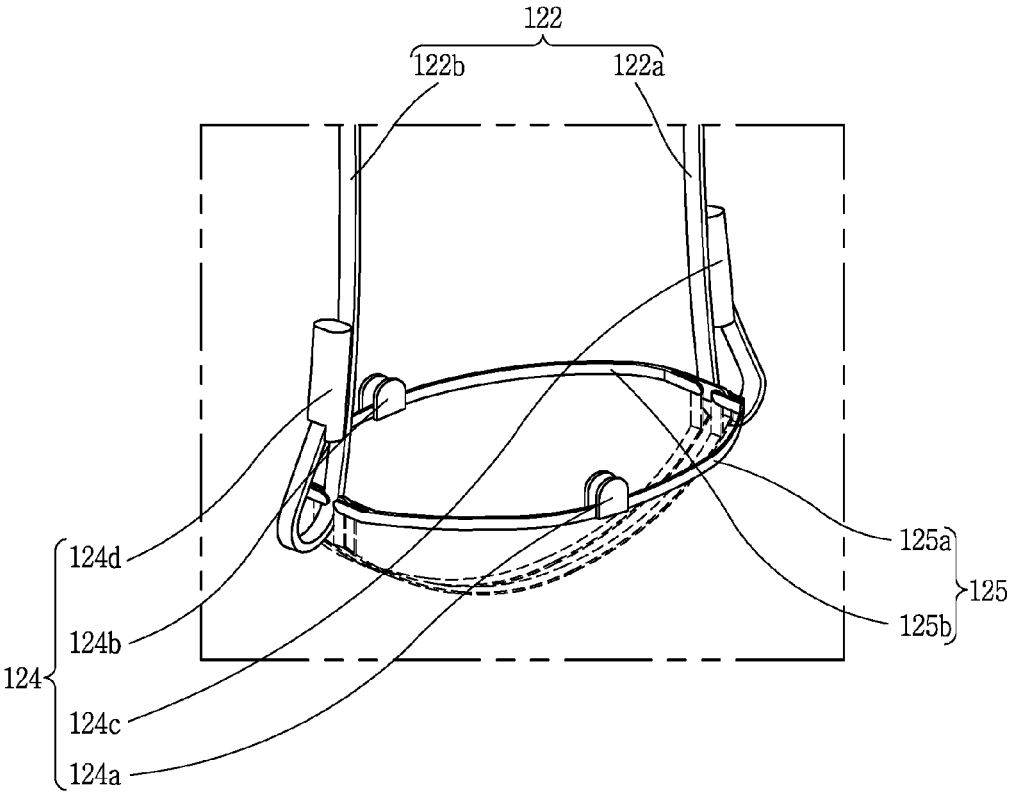
FIG. 5 is a conceptual view of a clip of FIG. 3.

Referring to FIG. 5, the clip 124 may be formed to fix a lower region of the clothing item 10. The clip 124 may be composed of a plurality of clips 124*a*, 124*b*, 124*c*, 124*d*, and may be configured to fix the lower region of the clothing item 10 at a plurality of positions. A sub frame 125 connected to the first and second extensions 122*a*, 122*b* may be provided at a lower end of the frame 122. The sub frame 125 may include a first connection bar 125*a* and a second connection bar 125*b* hinge-coupled to the first and second extensions 122*a*, 122*b* and which protrude in back and forth directions by rotation. The first and second connection bars 125*a*, 125*b* may have the same or similar structure as or to the first and second rotatable bars 123*a*, 123*b*.

If the clip 124 is composed of the plurality of clips 124*a*, 124*b*, 124*c*, 124*d*, some of the plurality of clips, such as, e.g., 124*c*, 124*d*, may be installed at the first and second extensions 122*a*, 122*b*, and others, such as, e.g., 124*a*, 124*b*, may be installed at the sub-frame 125 at, for example, the first and second connection bars 125*a*, 125*b*. The clips 124*a*, 124*b* may be provided at the first and second connection bars

125*a*, 125*b*, respectively, thereby fixing front and rear portions of a lower region of the clothing item 10. The clips 124*c*, 124*d* may be provided at lower regions of the first and second extensions 122*a*, 122*b*, respectively, thereby fixing right and left portions of the lower region of the clothing item 10. If the clothing item 10 is fixed by the plurality of clips in a state where the first and second connection bars 125*a*, 125*b* protrude in back and forth directions, the clothing item 10 may receive a uniform tension in back and forth and right and left directions or in an expanded state.

The clips 124*a*, 124*b*, 124*c*, 124*d* may be configured to fix the clothing item 10 by using, for example, an elastic force or a magnetic force. The first and second connection bars 125*a*, 125*b* may be provided with the clips 124*a*, 124*b* configured to execute a clamping operation by using an elastic force. The first and second extensions 122*a*, 122*b* may be provided, at lower regions thereof, with the clips 124*c*, 124*d* configured to execute a clamping operation by using a magnetic force.

Figure 6:
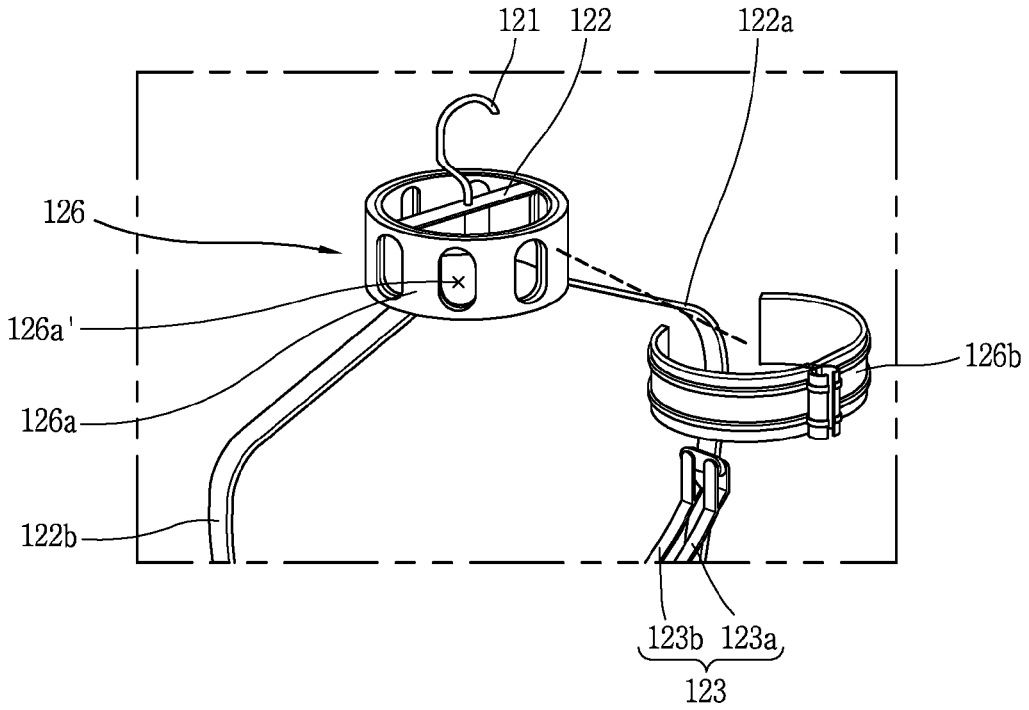
FIG. 6 is a conceptual view illustrating disassembled components of a collar press of FIG. 3.

Referring to FIG. 6, the collar press 126 may include a collar frame 126*a*, and a collar clip or brace 126*b* detachably mounted to the collar frame 126*a*. The collar frame 126*a* may be provided at an upper portion of the frame 122 and may be formed to have a circular shape such that a collar of the clothing item 10 may be mounted thereon. The collar of the clothing item 10 may be mounted on an outer circumference of the collar frame 126*a* in an unfolded state. A plurality of holes 126*a*' may be formed at the collar frame 126*a* such that steam may pass therethrough. For this, the collar frame 126*a* may be formed to have an empty inner space. The plurality of holes 126*a*' may be formed on an outer circumference of the collar frame 126*a* with a preset interval therebetween.

The collar brace 126*b* may be configured to compress a collar mounted on the collar frame 126*a* when mounted to the collar frame 126*a*. The collar brace 126*b* may be formed as a clamp that clamps using an elastic force and may be detachably mounted to the collar frame 126*a* by a user. An inner circumferential surface of the collar brace 126*b* may have a shape that corresponds to an outer circumferential surface of the collar frame 126*a* in order to compress a collar when mounted to the collar frame 126*a*. The collar frame 126*a* and the collar brace 126*b* may include a ductile material to help facilitate compression. For example, an outer circumference of the collar frame 126*a* and an inner circumference of the collar brace 126*b*, which may directly contact a collar, may be formed of silicone.

Figure 7:
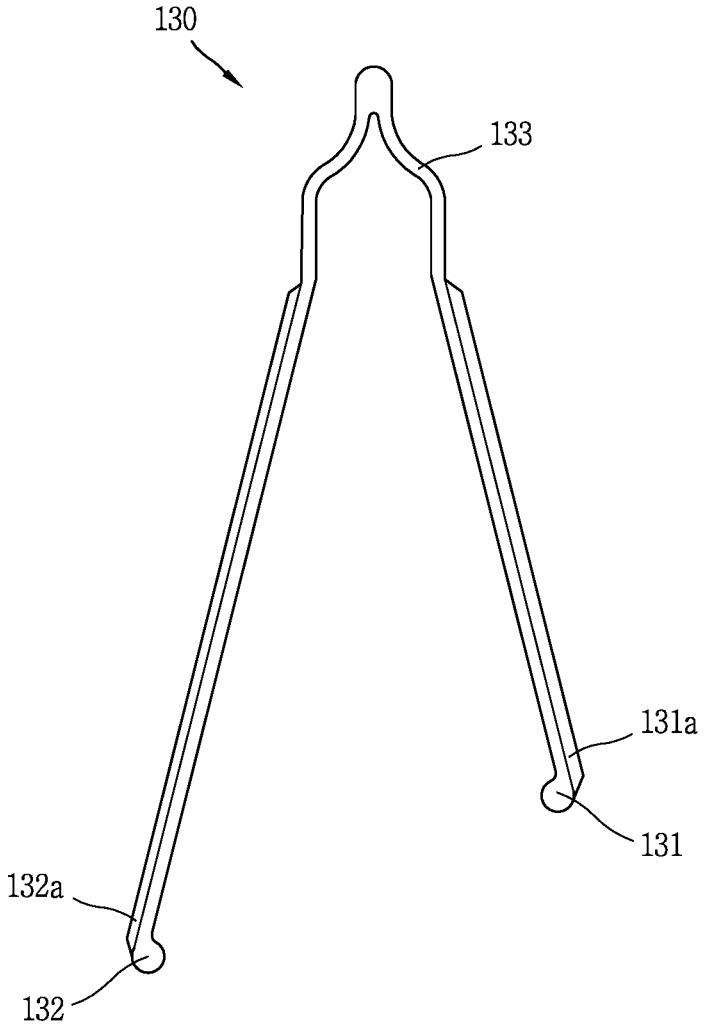
FIG. 7 is a conceptual view of a crease generator of FIG. 2.
Figure 8:
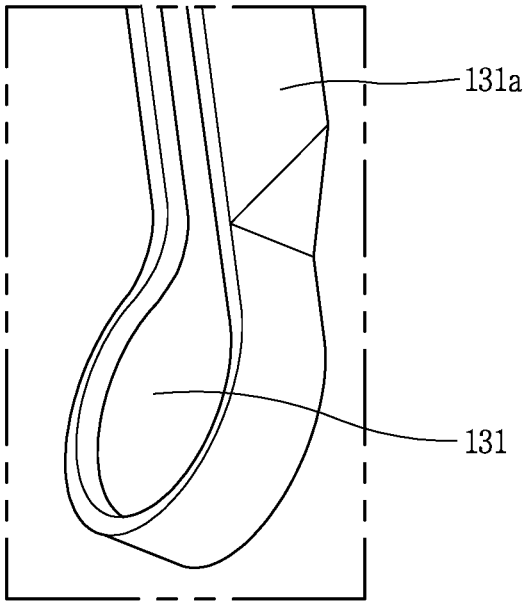
FIG. 8 is an enlarged view of a first portion of FIG. 7.

Referring to FIGS. 7 and 8, the crease generator 130 may be inserted into an arm region of the clothing item 10 to outward-press the arm region, thereby generating desired creases on the arm region. The creases may be generated on the arm region from the shoulder to the wrist. Also, the creases may be generated on the arm region from the armpit to the wrist. The crease generator 130 according to an embodiment may include a first tong portion 131, a second tong portion 132, and a connection part or connector 133.

The first and second tong portions or extensions 131, 132 may be spaced from each other and may extend to one direction. The first and second tong extensions 131, 132 may be formed as rods having a small thickness. The first and second tong extensions 131, 132 may be inserted into the arm region, and then may be provided to correspond to the arm region from the shoulder to the wrist and/or from the armpit to the wrist, thereby generating creases on the arm region.

The connector 133 may be connected to the first tong extension 131 and the second tong extension 132 and may be configured to apply an elastic force in a direction so that the first tong extension 131 and the second tong extension 132 become separated from each other. The connector 133 may be connected to one end of the first tong extension 131 and one end of the second tong extension 132, and may apply an elastic force to a direction so that another end of the first tong extension 131 and another end of the second tong extension 132 become separated from each other.

As shown in FIG. 8, the first tong extension 131 may be provided with a protrusion 131*a* protruded to have a sharp shape along the one direction, so as to generate creases on the arm region. The second tong extension 132 may be also provided with a protrusion 132*a* protruded to have a sharp shape along one direction. With such a configuration, creases may be generated not only on the aforementioned arm region from the shoulder to the wrist, but also on the arm region from the armpit to the wrist.

Since the crease generator 130 is inserted into an arm region of the clothing item 10 hung on the hanger 120, the crease generator 130 may hang downward due to gravity. The crease generator 130 may not separate from the arm region because the first and second tong extensions 131, 132 are locked to the arm region. To further prevent motion of the crease generator 130 after insertion, the crease generator 130 may include, for example, silicone and/or fabric.

The pocket wrinkle remover 140 may have a same or similar structure as or to the aforementioned crease generator 130. For instance, like the crease generator 130, the pocket wrinkle remover 140 may have a configuration that two extensions are elastically connected to each other by a connector. However, each of the two extensions may not be provided with a protrusion protruded to have a sharp shape.

Figure 9:
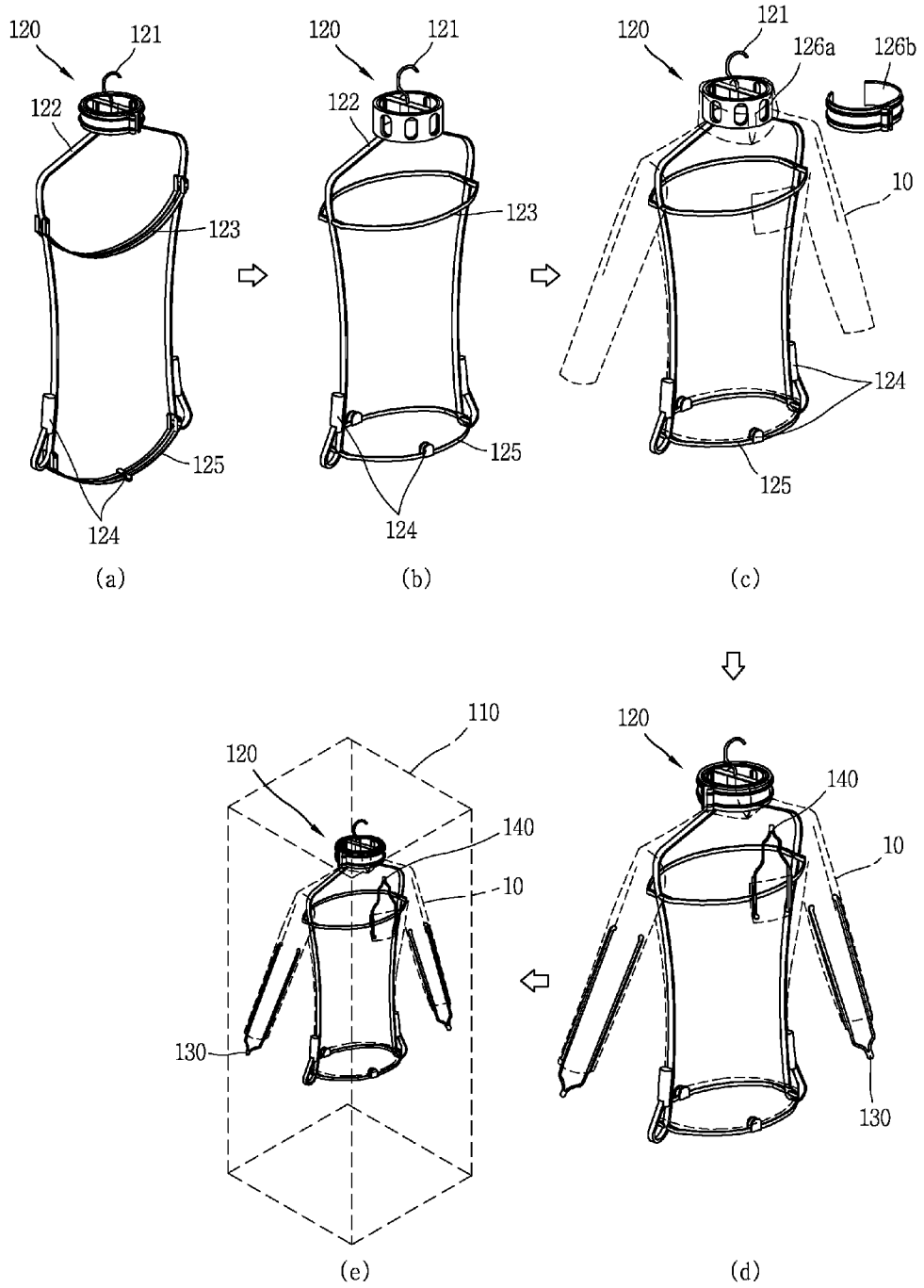
FIG. 9 is a conceptual view showing a hanging order of an item of clothing.

FIG. 9 is a view showing an order to hang the clothing item 10 according to an embodiment. Referring to FIG. 9, the first and second rotatable bars 123*a*, 123*b* may be folded when not used as shown in (a), but may be unfolded when used as shown in (b). The collar brace 126*b* of the collar press 126 may be kept in a coupled state to the collar frame 126*a* when not used. The crease generator 130 and the pocket wrinkle remover 140 may be kept in a hung state on the hanger 120, or may be kept in the housing 110.

Before hanging the clothing item 10 on the hanger 120 in order to remove wrinkles, the first and second rotatable bars 123*a*, 123*b* and the first and second connection bars 125*a*, 125*b* should be unfolded as shown in (b) of FIG. 9. Then, as shown in (c) of FIG. 9, the clothing item 10 may be hung on the hanger 120, and may be fixed to the hanger 120 by the brace 124. The clothing item 10 hung on the hanger 120 may receive tension from a plurality of directions by being pressed outwards or pulled by the body bar 123 and the clip 124. A collar of the clothing item 10 may be compressed by the collar press 126.

Then, as shown in (d) of FIG. 9, the crease generator 130 may be inserted into an arm region of the clothing item 10, thereby generating creases on the arm region from the shoulder to the wrist. The crease generator 130 may be hung on or in the arm region, and may apply a predetermined tension to the arm region. If the clothing item 10 is provided with a pocket, the pocket wrinkle remover 140 to remove wrinkles from the pocket may be inserted into the pocket.

As shown in (e) of FIG. 9, the clothing item 10, completely hung on hanger 120, may be provided in the accommodation space 111 of the housing 110, and may have wrinkles removed therefrom by steam and hot air and creases may be generated on the arm region.

Embodiments disclosed herein provide a clothes treating apparatus capable of effectively removing wrinkles from items of clothing, such as, e.g., a shirt and a blouse. A clothes treating apparatus may be capable of restricting wrinkles occurring in a horizontal direction or in a vertical direction, capable of removing wrinkles from a collar, and capable of generating desired creases on an arm region.

According to embodiments discloses herein, a clothes treating apparatus may include a housing having an accommodation space therein, and a hanger accommodated in the accommodation space and configured to hang a clothing item thereon. The hanger may include a hook configured to be detachably mounted to the housing, a frame having a first extension and a second extension that extend out in two directions from the hook and configured to support the clothing item by at least one of the first and second extensions, a body bar that connects to the first and second extensions and extends between the first and second extensions so as to press the clothing item outwards, and a clip provided at a lower portion of the hanger and configured to fix the clothing item.

The body bar may extend in a horizontal direction and may be configured to press the clothing item outwards in a direction crossing a pulling direction by the clip of the clothing item. The body bar may be provided between the hook and the clip and may be provided with a first rotatable bar and a second rotatable bar hinge-coupled to the first and second extensions. The first and second rotatable bars may protrude outwards in back and forth directions when rotated. The first and second rotatable bars may be formed to have an arc shape. The first and second rotatable bars are configured to have a rotation angle with respect to the frame be controllable.

The hanger may further include a sub frame connected to the first and second extensions at a lower end of the frame. The sub frame may include a first connection bar and a second connection bar hinge-coupled to the first and second extensions, and the first and second connection bars may be configured to protrude outwards in back and forth directions when rotated.

The clip may include a plurality of clips, and some of the clips are provided at the first and second extensions and remaining clips are provided at the first and second connection bars. The hanger may further include a collar press configured to compress or clamp a collar of the clothing item hung on the frame. The collar press may include a collar frame formed to mount the collar of the clothing item thereon, and a collar brace configured to compress the collar mounted on the collar frame. A plurality of holes may be formed at the collar frame such that steam passes therethrough. The collar frame and the collar brace include a ductile material.

The clothes treating apparatus may further include at least one crease generator or tong configured to generate creases on the clothing item by being inserted into the clothing item. The at least one crease tong may include first and second tong extensions spaced from each other that extend in one direction, and a connector that connects the first and second tong extensions and applies an elastic force in a direction such that the first and second tong extensions become separated from each other. The first tong extension may have a protrusion having a sharp edge along the one direction so as to generate creases on the clothing item. The at least one crease tong may be inserted into an arm region of the clothing item so as to generate creases at the arm region of the clothing item. The clothes treating apparatus may further include a pocket wrinkle remover or tong configured to remove wrinkles from a pocket of the clothing item and configured to be inserted into the pocket so as to extend toward two sides of the pocket.

According to embodiments discloses herein, a hanger may include a hook, a frame having a first extension and a second extension that extend out from two sides of the hook and support the clothing item by at least one of the first and second extensions, a body bar that connects to the first and second extensions and extends between the first and second extensions so as to press outwards on the clothing item, and a clip provided at a lower part of the hanger, and configured to fix the clothing item hung on the frame.

The body part of the clothing item may be pressed outwards by the body bar, and may be fixed by the clip in a downward-pulled state. The body part of the clothing item may receive tension in a balanced state by the body bar and the clip, in upper, lower, front, rear, right and left directions. Further, a collar of the clothing item may be compressed to be fixed by the collar press. A crease generator may be inserted into an arm region of the clothing item in order to generate creases on the arm region from the shoulder to the wrist. The crease generator may be configured to be hung on or in the arm region of the clothing item, after at least part thereof is inserted into the arm region. With such a configuration, a predetermined tension may be applied to the arm region. The pocket wrinkle remover configured to remove wrinkles from the pocket of the clothing item may be inserted into the pocket of the clothing item. The clothing item may be hung and fixed in an unfolded state without wrinkles, by the hanger, the crease generator, and the pocket wrinkle remover. Accordingly, a better wrinkle removing function may be executed when steam or hot air is provided to the clothing item.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A clothes treating apparatus, comprising:

a housing having an accommodation space therein; and a hanger accommodated in the accommodation space and configured to hang a clothing item thereon, the hanger including:

a hook configured to be detachably mounted to the housing;

a frame having a first extension and a second extension that extend out in two directions from the hook and configured to support the clothing item by at least one of the first and second extensions;

a body bar that connects to the first and second extensions and extends between the first and second extensions so as to press the clothing item outwards; and a clip provided at a lower portion of the hanger and configured to fix the clothing item, wherein the body bar is provided between the hook and the clip and is provided with a first rotatable bar and a second rotatable bar hinge-coupled to the first and second extensions, the first and second rotatable bars protrude outwards in back and forth directions when rotated.

2. The clothes treating apparatus of claim 1, wherein the body bar extends in a horizontal direction and is configured to press the clothing item outwards in a direction crossing a pulling direction by the clip of the clothing item.

3. The clothes treating apparatus of claim 1, wherein the first and second rotatable bars are formed to have an arc shape.

4. The clothes treating apparatus of claim 1, wherein the first and second rotatable bars are configured to have a rotation angle with respect to the frame be controllable.

5. The clothes treating apparatus of claim 1, wherein the hanger further includes a sub frame connected to the first and second extensions at a lower end of the frame.

6. The clothes treating apparatus of claim 5, wherein the sub frame includes a first connection bar and a second connection bar hinge-coupled to the first and second extensions, the first and second connection bars configured to protrude outwards in back and forth directions when rotated.

7. The clothes treating apparatus of claim 6, wherein the clip includes a plurality of clips, and some of the clips are provided at the first and second extensions and remaining clips are provided at the first and second connectors.

8. A clothes treating apparatus, comprising:

a housing having an accommodation space therein; and a hanger accommodated in the accommodation space and configured to hang a clothing item thereon, the hanger including:

a hook configured to be detachably mounted to the housing;

a frame having a first extension and a second extension that extend out in two directions from the hook and configured to support the clothing item by at least one of the first and second extensions;

a body bar that connects to the first and second extensions and extends between the first and second extensions so as to press the clothing item outwards;

a clip provided at a lower portion of the hanger and configured to fix the clothing item; and a collar press configured to clamp a collar of the clothing item hung on the frame, wherein the collar press includes:

a collar frame formed to mount the collar of the clothing item thereon; and a collar brace configured to clamp the collar mounted on the collar frame.

9. The clothes treating apparatus of claim 8, wherein a plurality of holes are formed at the collar frame such that steam passes therethrough.

10. The clothes treating apparatus of claim 8, wherein the collar frame and the collar brace include a ductile material.

11. A clothes treating apparatus, comprising:

a housing having an accommodation space therein;

a hanger accommodated in the accommodation space and configured to hang a clothing item thereon, the hanger including:

a hook configured to be detachably mounted to the housing;

a frame having a first extension and a second extension that extend out in two directions from the hook and configured to support the clothing item by at least one of the first and second extensions;

a body bar that connects to the first and second extensions and extends between the first and second extensions so as to press the clothing item outwards; and a clip provided at a lower portion of the hanger and configured to fix the clothing item; and at least one crease tong configured to generate creases on the clothing item by being inserted into the clothing item.

12. The clothes treating apparatus of claim 11, wherein the at least one crease tong includes:

first and second tong extensions spaced from each other that extend in one direction; and a connector that connects the first and second tong extensions and applies an elastic force in a direction such that the first and second tong extensions become separated from each other.

13. The clothes treating apparatus of claim 12, wherein the first tong extension has a protrusion having a sharp edge along the one direction so as to generate creases on the clothing item.

14. The clothes treating apparatus of claim 11, wherein the at least one crease tong is inserted into an arm region of the clothing item so as to generate creases at the arm region of the clothing item.

15. A clothes treating apparatus, comprising:

a housing having an accommodation space therein:

a hanger accommodated in the accommodation space and configured to hang a clothing item thereon, the hanger including:

a hook configured to be detachably mounted to the housing;

a frame having a first extension and a second extension that extend out in two directions from the hook and configured to support the clothing item by at least one of the first and second extensions;

a body bar that connects to the first and second extensions and extends between the first and second extensions so as to press the clothing item outwards; and a clip provided at a lower portion of the hanger and configured to fix the clothing item; and a pocket wrinkle tong configured to remove wrinkles from a pocket of the clothing item, and configured to be inserted into the pocket so as to extend toward two sides of the pocket.

16. A hanger, comprising a hook;

a frame having a first extension and a second extension that extend out from two sides of the hook and support the clothing item by at least one of the first and second extensions;

a body bar that connects to the first and second extensions and extends between the first and second extensions so as to press outwards on the clothing item;

a clip provided at a lower part of the hanger, and configured to fix the clothing item hung on the frame; and at least one tong configured to generate creases on the clothing item by being inserted into the clothing item or to remove wrinkles from a pocket of the clothing item by being inserted into the pocket.

17. The hanger of claim 16, further comprising a collar press configured to clamp a collar of the clothing item hung on the frame.

* * * * *